US006945856B2

(12) United States Patent
Boyd et al.

(10) Patent No.: US 6,945,856 B2
(45) Date of Patent: Sep. 20, 2005

(54) SUBAPERTURE CHEMICAL MECHANICAL PLANARIZATION WITH POLISHING PAD CONDITIONING

(75) Inventors: John M. Boyd, Atascadero, CA (US); Michael S. Lacy, Pleasanton, CA (US); David G. Halley, Los Osos, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

(21) Appl. No.: 10/374,494

(22) Filed: Feb. 25, 2003

(65) Prior Publication Data

US 2003/0153250 A1 Aug. 14, 2003

Related U.S. Application Data

(60) Division of application No. 09/709,972, filed on Nov. 10, 2000, now Pat. No. 6,547,651, and a continuation-in-part of application No. 09/693,040, filed on Oct. 20, 2000, now Pat. No. 6,464,574.

(60) Provisional application No. 60/164,640, filed on Nov. 10, 1999.

(51) Int. Cl.[7] ..... B24B 7/22; B24B 53/00

(52) U.S. Cl. ..... 451/56; 451/443; 451/72

(58) Field of Search ..... 451/285, 41, 72, 451/443, 444, 56, 289

(56) References Cited

U.S. PATENT DOCUMENTS 5,616,069 A * 4/1997 Walker et al. ..... 451/56
5,664,987 A 9/1997 Renteln
5,676,590 A 10/1997 Hiraoka
5,792,709 A 8/1998 Robinson et al.
5,938,504 A 8/1999 Talieh
6,022,807 A 2/2000 Lindsey, Jr. et al.
6,066,562 A 5/2000 Ohshima et al.
6,077,155 A 6/2000 Hayakawa et al.
6,093,088 A 7/2000 Mitsuhashi et al.
6,340,326 B1 1/2002 Kistler et al.
6,402,588 B1 6/2002 Matsuo et al.

OTHER PUBLICATIONS

IBM Research Disclosure Bulletin No. 32227, Pad Conditioning to Control Radial Uniformity of Mechanical Polishing, Feb. 1991.

* cited by examiner

*Primary Examiner*—Robert A. Rose
(74) *Attorney, Agent, or Firm*—Townsend and Townsend and Crew LLP

(57) ABSTRACT

Embodiments of the present invention are directed to polishing an object with polishing pad conditioning. In one embodiment, a method for polishing an object comprises placing a contact portion of a polishing pad in contact with a target surface of the object to be planarized over a contact area which is smaller in area than the target surface; conditioning a noncontact portion of the polishing pad which is not in contact with the target surface of the object; and moving the polishing pad relative to the target surface of the object to move the noncontact portion in contact with the target surface of the object and move the contact portion out of contact with the target surface of the object.

15 Claims, 4 Drawing Sheets

SUBAPERTURE CHEMICAL MECHANICAL PLANARIZATION WITH POLISHING PAD CONDITIONING

The present application is a divisional of U.S. patent application Ser. No. 09/709,972, filed Nov. 10, 2000 now U.S. Pat. No. 6,547,651, which is based on and claims the benefit of U.S. Provisional Patent Application No. 60/164,640, filed Nov. 10, 1999, and which is a continuation-in-part of U.S. patent application Ser. No. 09/693,040, entitled "Quick Pad Release Device for Chemical Mechanical Planarization," filed Oct. 20, 2000 now U.S. Pat. No. 6,464,574, the entire disclosures of which are incorporated herein by reference.

BACKGROUND OF THE INVENTION

The present invention relates to the manufacture of objects. More particularly, the invention provides a technique including a device for planarizing a film of material of an article such as a semiconductor wafer. However, it will be recognized that the invention has a wider range of applicability; it can also be applied to flat panel displays, hard disks, raw wafers, MR heads, precision optics and lens, and other objects that require a high degree of planarity.

The fabrication of integrated circuit devices often begins by producing semiconductor wafers cut from an ingot of single crystal silicon which is formed by pulling a seed from a silicon melt rotating in a crucible. The ingot is then sliced into individual wafers using a diamond cutting blade. Following the cutting operation, at least one surface (process surface) of the wafer is polished to a relatively flat, scratch-free surface. The polished surface area of the wafer is first subdivided into a plurality of die locations at which integrated circuits (IC) are subsequently formed. A series of wafer masking and processing steps are used to fabricate each IC. Thereafter, the individual dice are cut or scribed from the wafer and individually packaged and tested to complete the device manufacture process.

During IC manufacturing, the various masking and processing steps typically result in the formation of topographical irregularities on the wafer surface. For example, topographical surface irregularities are created after metallization, which includes a sequence of blanketing the wafer surface with a conductive metal layer and then etching away unwanted portions of the blanket metal layer to form a metallization interconnect pattern on each IC. This problem is exacerbated by the use of multilevel interconnects.

A common surface irregularity in a semiconductor wafer is known as a step. A step is the resulting height differential between the metal interconnect or silicon oxide and the wafer surface where the metal has been removed. A typical VLSI chip on which a first metallization layer has been defined may contain several million steps, and the whole wafer may contain several hundred ICs.

Consequently, maintaining wafer surface planarity during fabrication is important. Photolithographic processes are typically pushed close to the limit of resolution in order to create maximum circuit density. Typical device geometries call for line widths on the order of 0.5 $\mu$m. Since these geometries are photolithographically produced, it is important that the wafer surface be highly planar in order to accurately focus the illumination radiation at a single plane of focus to achieve precise imaging over the entire surface of the wafer. A wafer surface that is not sufficiently planar, will result in structures that are poorly defined, with the circuits either being nonfunctional or, at best, exhibiting less than optimum performance. To alleviate these problems, the wafer is "planarized" at various points in the process to minimize non-planar topography and its adverse effects. As additional levels are added to multilevel-interconnection schemes and circuit features are scaled to submicron dimensions, the required degree of planarization increases. As circuit dimensions are reduced, interconnect levels must be globally planarized to produce a reliable, high density device. Planarization can be implemented in either the conductor or the dielectric layers.

In order to achieve the degree of planarity required to produce high density integrated circuits, chemical-mechanical planarization processes ("CMP") are being employed with increasing frequency. A conventional rotational CMP apparatus includes a wafer carrier for holding a semiconductor wafer. A soft, resilient pad is typically placed between the wafer carrier and the wafer, and the wafer is generally held against the resilient pad by a partial vacuum. The wafer carrier is designed to be continuously rotated by a drive motor. In addition, the wafer carrier typically is also designed for transverse movement. The rotational and transverse movement is intended to reduce variability in material removal rates over the surface of the wafer. The apparatus further includes a rotating platen on which is mounted a polishing pad. The platen is relatively large in comparison to the wafer, so that during the CMP process, the wafer may be moved across the surface of the polishing pad by the wafer carrier. A polishing slurry containing chemically-reactive solution, in which are suspended abrasive particles, is deposited through a supply tube onto the surface of the polishing pad.

CMP is advantageous because it can be performed in one step, in contrast to prior planarization techniques which tend to be more complex, involving multiple steps. For example, planarization of CVD interlevel dielectric films can be achieved by a sacrificial layer etchback technique. This involves coating the CVD dielectric with a film which is then rapidly etched back (sacrificed) to expose the topmost portions of the underlying dielectric. The etch chemistry is then changed to provide removal of the sacrificial layer and dielectric at the same rate. This continues until all of the sacrificial layer has been etched away, resulting in a planarized dielectric layer.

Many other limitations, however, exist with CMP. Specifically, CMP often involves a large polishing pad, which uses a large quantity of slurry material. The large polishing pad is often difficult to control and requires expensive and difficult to control slurries. Additionally, the large polishing pad is often difficult to remove and replace. The large pad is also expensive and consumes a large foot print in the fabrication facility. These and other limitations still exist with CMP and the like.

What is needed is an improvement of the CMP technique to improve the degree of global planarity and uniformity that can be achieved using CMP.

SUMMARY OF THE INVENTION

The present invention achieves these benefits in the context of known process technology and known techniques in the art. The present invention provides an improved planarization apparatus for chemical mechanical planarization (CMP). Specifically, the present invention provides an improved planarization apparatus that provides multi-action CMP, such as orbital and spin action, to achieve uniformity during planarization. The present invention further provides conditioning of the polishing pad for subaperture chemical mechanical planarization wherein the polishing pad has a contact area with the workpiece that is smaller than the size of the workpiece.

In accordance with an aspect of the present invention, a chemical-mechanical planarization apparatus for planarizing an object comprises a platen assembly for holding an object having a target surface to be planarized. A polishing pad is configured to contact the object during planarization with a contact portion over a contact area which is smaller in area than the target surface. The polishing pad has a noncontact portion which is not in contact with the object during planarization. The polishing pad is movable relative to the object to move the noncontact portion in contact with the object and move the contact portion out of contact with the object. A conditioner is configured to condition the noncontact portion of the polishing pad.

In some embodiments, the polishing pad is annular. In other embodiments, the polishing pad has a solid circular surface for contacting the target surface with at least a portion thereof. The noncontact portion of the polishing pad may overhang the target surface of the object, and the conditioner is disposed below the noncontact portion. The polishing pad may be selected from the group consisting of a pad for use with a loose abrasive, a pad with a fixed abrasive, and a grinding pad. The polishing pad may be rotatable relative to the object to move the noncontact portion in contact with the object and move the contact portion out of contact with the object. The object may be rotatable around an axis perpendicular to the target surface.

In specific embodiments, the conditioner is configured to condition the noncontact portion of the polishing pad during planarization of the object by the polishing pad. The conditioning may be continuous or intermittent. The conditioner may comprise a conditioning plate, such as a diamond conditioning disk. The conditioning plate may be stationary. The conditioning plate may be rotatable. The conditioning plate may be an annular plate surrounding the target surface of the object. The annular plate may be stationary, or may be configured to rotate around the object or oscillate in rotation relative to the object. The annular plate may form a retaining ring around the target surface of the object. The annular plate may include an annular band adjacent to and surrounding an edge of the target surface, where the annular band performs no conditioning on the target surface.

In some embodiments, the polishing pad is movable in translation across the target surface of the object and the conditioning plate may move in translation with the polishing pad. The conditioner may comprise a pressurized fluid to be directed to the noncontact portion of the polishing pad. The pressurized fluid may be ultrasonic energized. The pressurized fluid may comprise at least one of deionized water, KOH, and a slurry.

In accordance with another aspect of the invention, a method for planarizing an object by chemical mechanical planarization comprises placing a contact portion of a polishing pad in contact with a target surface of the object to be planarized over a contact area which is smaller in area than the target surface. A noncontact portion of the polishing pad which is not in contact with the target surface of the object is conditioned. The polishing pad is moved relative to the target surface of the object to move the noncontact portion in contact with the target surface of the object and move the contact portion out of contact with the target surface of the object.

In some embodiments, the noncontact portion of the polishing pad comprises dislodging particles from a surface thereof. Conditioning the noncontact portion of the polishing pad may comprise placing a conditioning plate in contact with the noncontact portion. The polishing pad may be moved in translation across the target surface of the object and the conditioning plate may be moved in translation with the polishing pad. Conditioning the noncontact portion of the polishing pad may comprise directing a pressurized fluid to the noncontact portion. The noncontact portion of the polishing pad may be conditioned during planarization of the object by the polishing pad, and the conditioning may be continuous during planarization of the object.

In specific embodiments, the polishing pad is rotated relative to the object to move the noncontact portion in contact with the target surface of the object and move the contact portion out of contact with the target surface of the object. The object may be rotated around an axis perpendicular to the target surface. An abrasive may be delivered to the contact area between the polishing pad and the target surface of the object.

DESCRIPTION OF THE SPECIFIC EMBODIMENTS

According to specific embodiments of the present invention, a technique including a device for chemical mechanical planarization of objects is provided. In an exemplary embodiment, the invention provides a polishing pad, which is mounted on a cap. The cap is rotatably coupled to a drive head of a polishing apparatus. The apparatus includes a smaller polishing pad, relative to the size of the object being polished.

Figure 1A:
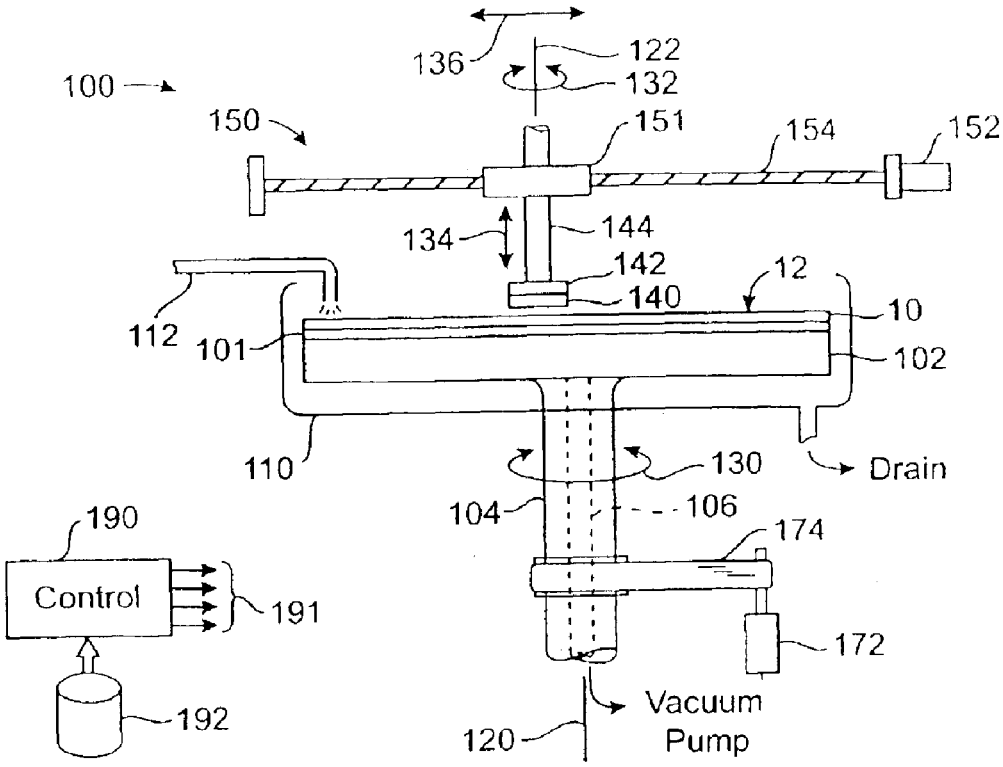
FIG. 1A is a simplified polishing apparatus according to an embodiment of the present invention.

Referring to FIG. 1A, a chemical-mechanical planarization apparatus 100 includes a chuck 102 for holding a wafer 10 in position during a polishing operation. The apparatus shown is merely an example and has been simplified to facilitate a discussion of the salient aspects of the invention. As such, the figure should not unduly limit the scope of the claims herein. One of ordinary skill in the art would recognize many other variations, alternatives, and modifications.

The chuck includes a drive spindle 104 which is coupled to a motor 172 via a drive belt 174 to rotate the wafer about its axis 120. Preferably, the motor is a variable-speed device so that the rotational speed of the wafer can be varied. In addition, the direction of rotation of the motor can be reversed so that the wafer can be spun in either a clockwise direction or a counterclockwise direction. Typically, servo motors are used since their speed can be accurately controlled, as well as their direction of rotation. Alternative drive means include, but are not limited to, direct drive and gear-driven arrangements.

A channel 106 formed through spindle 104 is coupled to a vacuum pump through a vacuum rotary union (not shown). Chuck 102 may be a porous material, open to ambient at its upper surface so that air drawn in from the surface through channel 106 creates a low pressure region near the surface. A wafer placed on the chuck surface is consequently held in place by the resulting vacuum created between the wafer and the chuck. Alternatively, chuck 102 may be a solid material having numerous channels formed through the upper surface, each having a path to channel 106, again with the result that a wafer placed atop the chuck will be held in position by a vacuum. Such vacuum-type chucks are known and any of a variety of designs can be used with the invention. In fact, mechanical clamp chucks can be used. However, these types are less desirable because the delicate surfaces of the wafer to be polished can be easily damaged by the clamping mechanism. In general, any equivalent method for securing the wafer in a stationary position and allowing the wafer to be rotated would be equally effective for practicing the invention.

A wafer backing film 101 is disposed atop the surface of chuck 102. The backing film is typically a polyurethane material. The material provides compliant support structure which is typically required when polishing a wafer. When a compliant backing is not used, high spots on a wafer prevent the pad from contacting the thinner areas (low spots) of the wafer. The compliant backing material permits the wafer to deflect enough to flatten its face against the polish pad. There can be a deflection of several thousands of an inch deflection under standard polishing forces. Polyurethane is not necessary, however, as any appropriate compliant support material will work equally well. In addition, the backing film typically includes a pressure sensitive adhesive (PSA) film on its bottom surface for coupling with the chuck 102. The PSA film desirably includes a plurality of holes that may be formed by laser to permit application of a vacuum from the chuck 102 on the bottom of the wafer.

FIG. 1A also shows a polishing pad assembly comprising a polishing pad 140, a chuck 142 for securing the pad in position, and a pad spindle 144 coupled to the chuck for rotation of the pad about its axis 122. In the specific embodiment shown, the pad radius is less than the radius of wafer 10. As discussed below, other pad sizes may be used in other embodiments. A drive motor (not shown) is coupled to pad spindle 144 to provide rotation of the pad. Preferably, the drive motor is a variable-speed device so that the rotational speed of pad 140 during a particular polishing operation can be controlled. The drive motor preferably is reversible. A conditioner 145 is desirably provided for conditioning the pad 140, which is discussed in more detail below.

Figure 1B:
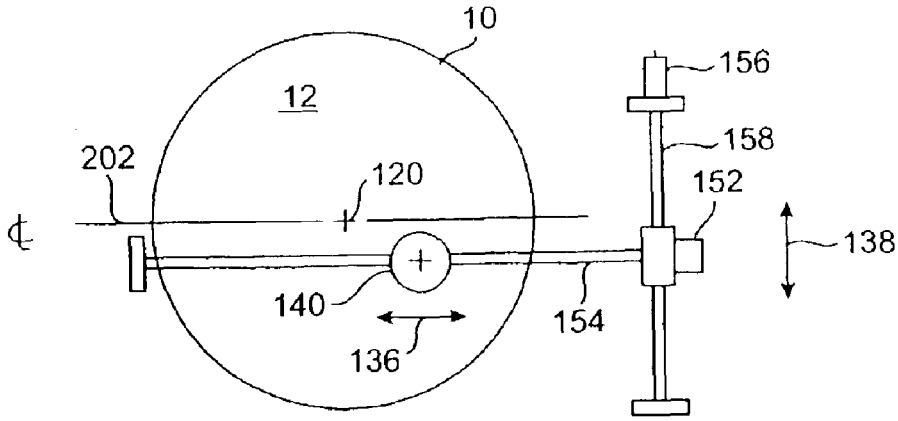
FIG. 1B is an alternative detailed diagram of a polishing apparatus according to an embodiment of the present invention.

Referring to FIGS. 1A and 1B, a traverse mechanism 150 provides translational displacement of the polishing pad assembly across the wafer surface. In one embodiment of the invention, the traverse mechanism is an x-y translation stage that includes a platform 151 for carrying the pad assembly. The traverse mechanism 150 further includes drive screws 154 and 158, each respectively driven by motors 152 and 156 to move platform 151. Motors 152 and 156 respectively translate platform 151 in the x-direction, indicated by reference numeral 136, and in the y-direction, indicated by reference numeral 138. Motors 152 and 156 preferably are variable-speed devices so that the translation speed can be controlled during polishing. Stepper motors are typically used to provide high accuracy translation and repeatability.

It is noted that the function of traverse mechanism 150 can be provided by other known translation mechanisms as alternatives to the aforementioned x-y translation stage. Alternative mechanisms include pulley-driven devices and pneumatically operated mechanisms. The present invention would be equally effective regardless of the particular mechanical implementation selected for the translation mechanism.

Figure 2:
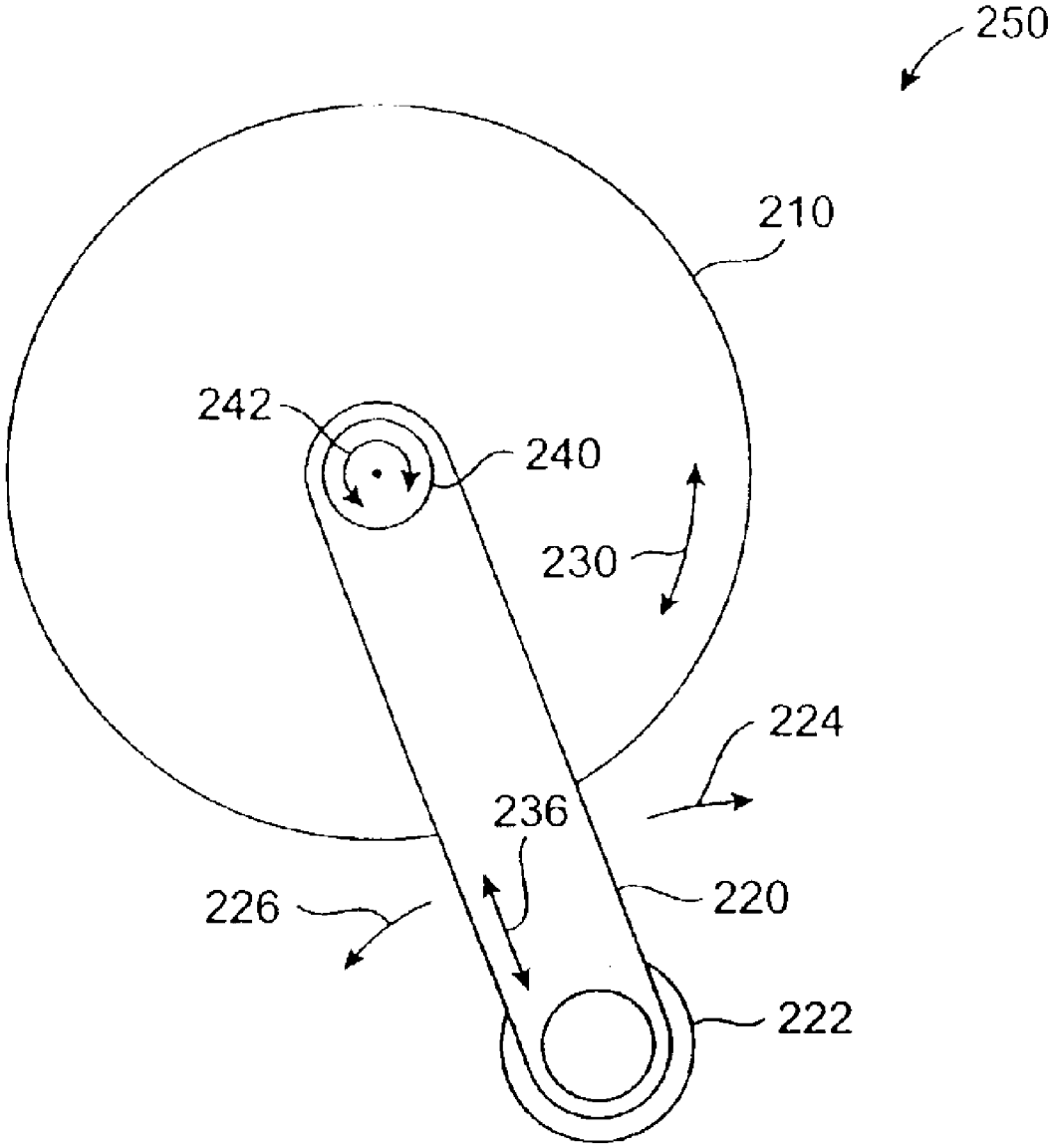
FIG. 2 is a simplified top plan view of a polishing apparatus according to another embodiment of the present invention.

For example, FIG. 2 shows another traverse mechanism 250 which provides angular displacement of the polishing pad assembly across the surface of the wafer 210. A rotational arm 220 is driven by an actuator 222 to rotate the polishing pad 240 coupled to its end, as indicated by arrows 224, 226. The pad 240 spins around its axis as shown by arrows 242. The wafer 210 rotates as shown by arrows 230. These rotations allow the pad 240 to contact and planarize the entire surface of the wafer 210. An optional translation of the arm 220 to move the pad 240 along arrows 236 may be provided.

Continuing with FIG. 1A, the pad 140 is oriented relative to wafer 10 such that process surface 12 of the wafer is substantially horizontal and faces upwardly. The polishing surface of pad 140 is lowered onto process surface 12 of the wafer. This arrangement of wafer surface to pad surface is preferred. If a power failure occurs, the various components in the CMP apparatus will likely cease to operate. In particular, the vacuum system is likely to stop functioning. Consequently, wafer 10 will no longer be held securely in place by vacuum chuck 102. However, since the wafer is already in a neutral position, the wafer will not fall and become damaged when the chuck loses vacuum but will simply rest upon the chuck.

The pad assembly is arranged on the translation stage of traverse mechanism 150 to allow for motion in the vertical direction which is indicated in FIG. 1A by reference numeral 134. This allows for lowering the pad onto the wafer surface for the polishing operation. Preferably, pad pressure is provided by an actuator (e.g., a piston-driven mechanism, voice coil, servo motor, lead screw assembly, and the like) having variable-force control in order to control the downward pressure of the pad upon the wafer surface. The actuator is typically equipped with a force transducer to provide a downforce measurement which can be readily converted to a pad pressure reading. Numerous pressure-sensing actuator designs, known in the relevant engineering arts, can be used.

In some embodiments, a slurryless abrasive for the polishing pad may be used. For polishing with a slurry, a slurry delivery mechanism 112 is provided to dispense a polishing slurry onto process surface 12 of wafer 10 during a polishing operation. Although FIG. 1A shows a single dispenser 122, additional dispensers may be provided depending on the polishing requirements of the wafer. Polishing slurries are known in the art. For example, typical slurries include a mixture of colloidal silica or dispersed alumina in an alkaline solution such as KOH, $NH_4OH$ or $CeO_2$. Alternatively, slurry-less pad systems can be used.

A splash shield 110 is provided to catch the polishing fluids and to protect the surrounding equipment from the caustic properties of any slurries that might be used during polishing. The shield material can be polypropylene or stainless steel, or some other stable compound that is resistant to the corrosive nature of polishing fluids.

A controller 190 in communication with a data store 192 issues various control signals 191 to the foregoing-described components of polishing apparatus 100. The controller provides the sequencing control and manipulation signals to the mechanics to effectuate a polishing operation. The data store 192 preferably is externally accessible. This permits user-supplied data to be loaded into the data store to provide polishing apparatus 100 with the parameters for performing a polishing operation. This aspect of the preferred embodiment will be further discussed below.

Any of a variety of controller configurations are contemplated for the present invention. The particular configuration will depend on considerations such as throughput requirements, available footprint for the apparatus, system features other than those specific to the invention, implementation costs, and the like. In one embodiment, controller 190 is a personal computer loaded with control software. The personal computer includes various interface circuits to each component of polishing apparatus 100. The control software communicates with these components via the interface circuits to control apparatus 100 during a polishing operation. In this embodiment, data store 192 can be an internal hard drive containing desired polishing parameters. User-supplied parameters can be keyed in manually via a keyboard (not shown). Alternatively, data store 192 is a floppy drive in which case the parameters can be determined elsewhere, stored on a floppy disk, and carried over to the personal computer. In yet another alternative, data store 192 is a remote disk server accessed over a local area network. In still yet another alternative, the data store is a remote computer accessed over the Internet; for example, by way of the world wide web, via an FTP (file transfer protocol) site, and so on.

In another embodiment, controller 190 includes one or more microcontrollers which cooperate to perform a polishing sequence in accordance with the invention. Data store 192 serves as a source of externally-provided data to the microcontrollers so they can perform the polish in accordance with user-supplied polishing parameters. It should be apparent that numerous configurations for providing user-supplied polishing parameters are possible. Similarly, it should be clear that numerous approaches for controlling the constituent components of the CMP are possible.

Figure 3:
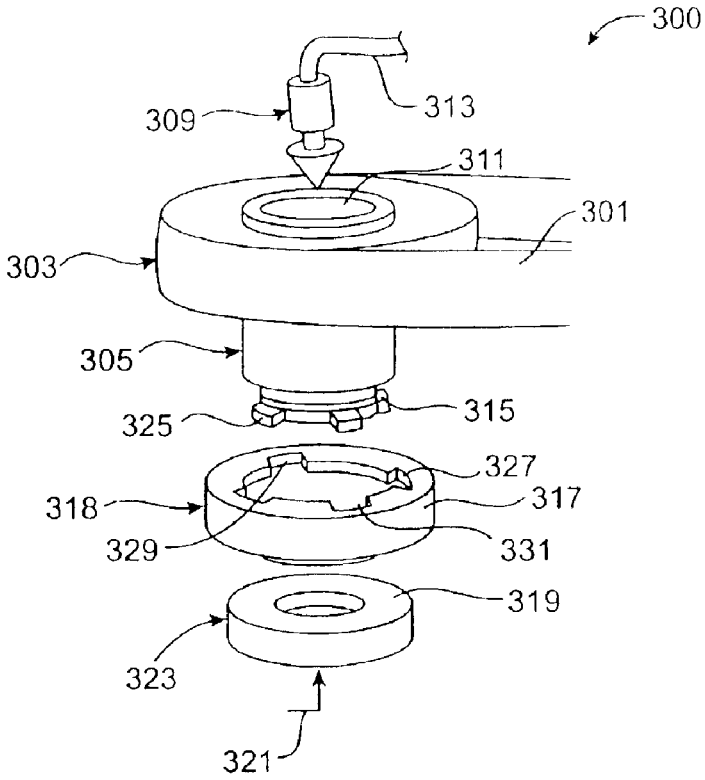
FIG. 3 is a simplified diagram of a drive and cap assembly according to an embodiment of the present invention.
Figure 3A:
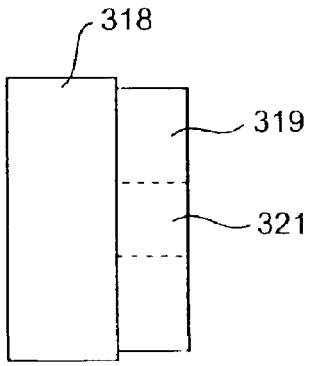
FIG. 3A is a simplified diagram of a combined cap and pad assembly according to an embodiment of the present invention.
Figure 4:
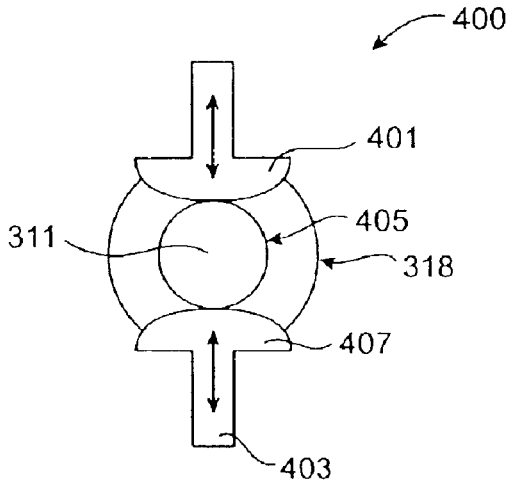
FIG. 4 is a simplified diagram of a polishing pad according to an embodiment of the present invention.

Automation of polish pad changing is desirable since throughput and flexibility of the process is achieved in a more efficient manner with automation. Automated pad change allows for multiple pad types to be applied to the same wafer as well as the reuse of a polish pad. FIGS. 3, 3A, and 4 provide one embodiment of implementing an automated pad change system and method. It is understood that other ways of automated polishing pad changing may be used.

FIG. 3 is a simplified diagram of a drive and cap assembly on a polishing head 300 according to an embodiment of the present invention. The assembly is merely an example and has been simplified to facilitate a discussion of the salient aspects of the invention. As such, the figure should not unduly limit the scope of the claims herein. One of ordinary skill in the art would recognize many other variations, alternatives, and modifications. As shown, the polishing head 300 includes a variety of features such as a support structure 301, which couples to a support. Additionally, the polishing head includes a drive device 303, which couples to a drive shaft 305. The drive shaft has a first end, which is attached to the drive device, and a second end, which includes a coupling 315. The coupling mates to a removable cap 317, which includes an outer region 318. The removable cap rotatably attaches to the coupling in a secure manner. Although the present cap is rotatable, there can be other ways of attaching the cap to the coupling. The rotatable cap also has a polishing pad 323, which can be fixed to the cap before it is secured to the coupling. The polishing pad may have an opening 321, but can also be one continuous member. The top surface 319 of the pad contacts the cap to secure it in place.

Now, to secure the removable cap onto the coupling, the cap is brought into contact and is aligned to the coupling. Here, each of the threads 325 is aligned with a respective thread opening 327, inserted along a first direction toward the support structure, until each thread bottoms against a stop 329 in the opening. Next, the cap is rotated in a counter clockwise manner, where the groove 331 guides each thread such that the cap biases against the coupling to secure it in place. Once the cap is secured, the drive 305 rotates the pad in a counter clockwise circular manner during a process operation. By way of the counter clockwise manner, the cap does not loosen up and continues to be biased against the coupling. In other embodiments, the rotatable cap and coupling are mated to each other in a clockwise manner, where the drive rotates the pad in a clockwise manner.

To remove the cap from the coupling, the drive is secured in place manually or by a brake, where the rotatable coupling cannot be rotated through the drive. The cap is grasped and turned in a clockwise manner, which guides each thread away from the bias to release the cap from the coupling. Once each thread is aligned with its opening, the cap is dropped to free it from the coupling. Again, in other embodiments, the rotatable cap and coupling have been mated to each other in a clockwise manner, where the drive rotates the pad in a clockwise manner. In a preferred embodiment, the present cap is removed from the coupling by way of the technique illustrated by FIG. 4 below. This technique provides an automatic or "hands free" approach to removing the cap from the coupling.

The present cap, which is rotatably attached, can be replaced by other types of coupling devices. Of course, the type of coupling device used depends upon the application.

The polishing head also includes a sensing device 309, which is coupled to a processing unit, such as the one noted but can be others. The sensing device can look through an inner opening 311 of the drive shaft 305 to the polishing pad. In some embodiments, the polishing pad is annular in structure with an opening 321 in the center. The opening allows the sensor to sense a fluid level or slurry level at the workpiece surface, which is exposed through the center opening in the pad. Of course, the type of coupling device used depends upon the application.

FIG. 3A is a simplified diagram of a combined cap and pad assembly according to an embodiment of the present invention. This diagram is merely an illustration, which should not limit the scope of the claims herein. One of ordinary skill in the art would recognize many other variations, modifications, and alternatives. In a specific embodiment, the removable cap and polishing pad are in an assembly. The assembly is provided to the manufacturer of integrated circuits, for example, for use with the present polishing apparatus. The assembly can be pre-packaged in a clean room pack. The assembly can include the cap 318 and the pad 319, which may include an inner orifice or opening 321. Depending upon the embodiment, the pad can be one of a variety according to the present invention.

The cap can be made of a suitable material to withstand both chemical and physical conditions. Here, the cap can be made of a suitable material. The cap is also preferably transparent, which allows the sensing device to pick up optical signals from the workpiece surface. The cap is also sufficiently rigid to withstand torque from the drive shaft. The cap can also withstand exposure to acids, bases, water, and other types of chemicals, depending upon the embodiment. The cap also has a resilient outer surface to prevent it from damage from slurries, abrasive, and other physical materials. Further details of removing the cap are provided below.

FIG. 4 is a simplified diagram of a polishing pad device 400 according to an embodiment of the present invention. The device is merely an example and has been simplified to facilitate a discussion of the salient aspects of the invention. As such, the figure should not unduly limit the scope of the claims herein. One of ordinary skill in the art would recognize many other variations, alternatives, and modifications. In a preferred embodiment to remove the cap, the cap 318 is placed between two handling arms 401, 403. Each of the arms places a lateral force against the cap to hold it in place. The motor drives the drive shaft in a clockwise (or counter clockwise) manner to release the threads of the cap from the coupling. Once the threads have been released the drive shaft is lifted to free the cap from the coupling.

Next, the removed cap is placed into a disposal. Here, the handling arms can move the cap from a removal location to a disposal location.

Figure 5:
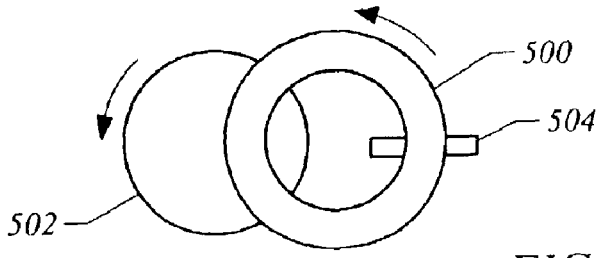
FIG. 5 is a simplified top plan view of a polishing apparatus with a conditioner according to another embodiment of the invention.
Figure 6:
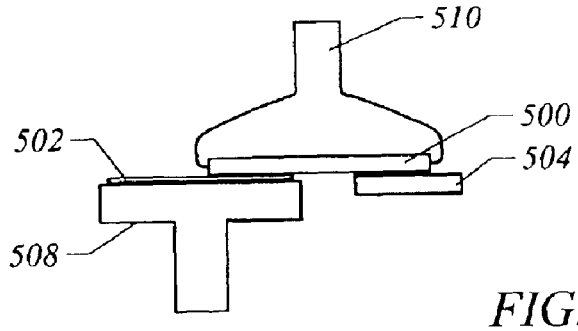
FIG. 6 is a simplified elevational view of the polishing apparatus of FIG. 5.

FIGS. 5 and 6 show a polishing pad 500 for polishing a wafer 502 and a conditioner 504 for conditioning the pad 500. The pad 500 covers only a portion of the wafer 502 during polishing. FIG. 5 shows an annular pad 500, but a solid pad may be used in other embodiments. The outer diameter of the annular pad 500 may be smaller or larger than the diameter of the wafer 502. In a specific embodiment, the outer diameter of the annular pad 500 is approximately equal to the diameter of the wafer 502. The inner diameter of the pad 500 may range from zero (solid pad) to just below its outer diameter. An annular pad may be advantageous because a higher pressure is achieved under the same downforce due to the decrease in surface area. The CMP system shown employs a small footprint where the polishing module is in the order of about 5 times the area of the wafer being polished, as opposed to about 20 times the area for conventional CMP tools.

The polishing pad 500 has a contact area with the wafer 502 that is smaller than the size of the wafer 502. This is referred to as subaperture CMP. At the same time, the pad 500 is sufficiently large to allow conditioning of the pad 500 by the conditioner 504 at an overhang position off the wafer during CMP processing. The pad 500 may be used for polishing only one wafer and changed between wafers, or may be used for polishing several wafers between changing pads. An automatic pad change mechanism may be used. The pad 500 may employ a loose abrasive, a fixed abrasive on the pad, or may be a grinding pad. These alternatives are desirably provided on the same CMP apparatus. For instance, a modular system can be used to provide different capabilities for CMP and conditioning.

As shown in FIGS. 5 and 6, the rotating pad 500 (e.g., in a θ motion) traverses the rotating wafer 502 to polish the entire surface (e.g., in an x-axis motion) as it contacts the wafer surface under a downforce applied toward the wafer surface by the pad holder 510 (e.g., in a z-axis motion). The wafer 502 is rotatable by the wafer platen or support 508. The uniformity of the CMP process is achieved by adjusting the pad dwell time as well as other controls. Closed loop process control is desirably used to provide the information to control the various degrees of freedom (e.g., wafer rotation speed, pad rotation speed, dwell time along the x-axis, rotation speed as a function of the x-axis position and time, and downforce as a function of x-axis position and time). The conditioner 504 is disposed off to the side of the wafer 502. The pad 500 moves in and out of the wafer 502 and the conditioner 504, either in situ during the wafer CMP process, or ex situ between wafer polishing passes. Thus, the conditioning can be continuous or intermittent. The conditioner may be a diamond conditioning disk or a high pressure fluid directed to the pad 500 to dislodge particles from CMP and prevent buildup on the pad surface which may scratch the wafer surface. The conditioning of the pad may include breaking off from the pad particles generated during CMP, roughening the pad surface to allow entrainment of slurry particles for CMP, or the like. The conditioning produces a more uniform removal process with a more steady removal rate.

FIGS. 5 and 6 show the pad conditioner 504, which may be a conditioning disk, turned face up to contact the annular pad 500. The conditioner 504 is sufficiently large in area to be stationary to contact the pad 500 as the pad 500 moves over the conditioner 504. In alternative embodiments, the conditioning member may rotate independently or passively via contact with the rotating pad 500. The conditioner 504 may be adjustable in vertical height relative to the wafer 502 and pad 500. The conditioner 504 may also be adjustable in horizontal translation relative to the pad 500 to move it into contact position with the pad 500 and away from the pad 500. Furthermore, for a pad 500 that translates as well as rotates, the conditioner 504 may move in translation with the pad 500 to ensure contact. Alternatively, the conditioner 504 may be sufficiently large that contact with the pad 500 is maintained even after translation of the pad 500.

Figure 7:
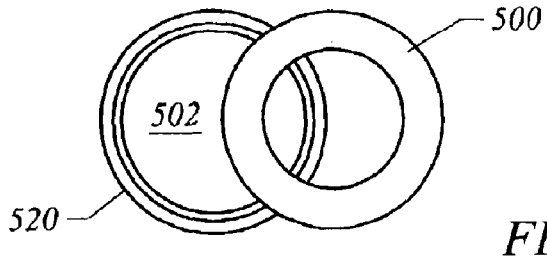
FIG. 7 is a simplified top plan view of a polishing apparatus with an annular conditioner according to another embodiment of the invention.
Figure 8:
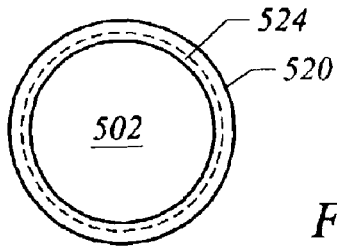
FIG. 8 is a top plan view of an annular conditioner according to another embodiment of the invention.

In another embodiment shown in FIG. 7, the conditioner 520 is an annular member that surrounds the wafer 502. The conditioner 520 may be stationary, may rotate with the wafer 502, or may rotate independently. The conditioner 520 may also oscillate in rotation back and forth around the wafer 502. The annular conditioner 520 may be adjustable in height relative to the wafer 502 and pad 500. The annular conditioner 520 may further act as a retaining ring around the wafer 502. The height of the ring can be used to help control edge exclusion by supporting the polishing pad 500 as it transitions across the boundary between the wafer 502 and the conditioner 520. In one embodiment shown in FIG. 8, the annular conditioner 520 may include a separate flat section 524 without conditioning material forming an annular band adjacent the wafer 500 to support the transition between the wafer 502 and the conditioner/retainer ring 520 for edge exclusion versus conditioning control. The vertical height of the conditioner 520 may be controlled automatically via servo positioning with possible sensor feedback to accommodate variations in wafer thickness, wafer backing film wear, or compression, or even in situ performance feedback to better control edge exclusion. The edge exclusion may be reduced from typically about 5 mm to about 1 mm.

Alternatively or additionally, a fluid, such an ultra or mega-sonic energized fluid, may be used to clean and condition the polishing pad 500. The fluid may include deionized water, KOH, a slurry, or the like. In a specific embodiment, the conditioning may be performed by mechanical and acoustic energy with chemicals.

In some embodiments, the pad conditioner moves with the pad in translation. In other embodiments, the pad conditioner moves independently of the pad to better randomize conditioning action.

The present invention advantageously avoids the fluid distribution problem by delivering the fluid directly to the wafer surface or by using fixed-abrasive or slurryless abrasive for subaperture CMP. The fluid may include a slurry, a chemical, or the like. The fluid distribution problem arises when the fluid is applied to an area of the pad that is not involved in polishing the wafer during CMP and dries on the pad to form a buildup that may cause severe scratching of the wafer surface when it subsequently comes in contact with the wafer. This problem is more common in large pad CMP. By delivering the fluid directly to the wafer surface or by using fixed abrasive or slurryless abrasive for subaperture CMP, the fluid distribution problem is avoided. The targeted fluid delivery also decreases the amount of fluid used and maximizes its effectiveness while reducing cost.

The following describes various ways of supplying the slurry or chemical to the wafer surface. A stationary or movable supply tube may poke up in the center region of the annular pad to present the slurry or chemical to the surface of the wafer to capture the fluid inside the annulus. The slurry or chemical may be supplied through the center of the rotating spindle of the pad holder as it is rotating. The slurry or chemical may be sprayed onto the upper surface of an inverted cup formed by a cavity defined inside the annulus of the polishing pad and the bottom side of the pad holder. The solution will then flow down the wall of the cup onto the surface of the wafer-pad interface. The inner cavity may be designed such that the fluid is injected into an annular cavity on the inside of the pad holder with single or multiple passages leading to holes in the pad. The fluid is not supplied through the spindle of the pad holder, but does eventually flow to holes or slots in the pad or to areas between the pad segments. Alternatively, the fluid may be supplied directly to the downward facing surface of the pad as it is traversing onto contact with the wafer. For the annular conditioner shown in FIG. 8, the fluid may be fed between the annular conditioner and the wafer edge, either locally where the pad enters or all the way around. The fluid may instead be applied to the upper surface of the wafer where exposed.

While the above is a full description of the specific embodiments, various modifications, alternative constructions and equivalents known to those of ordinary skill in the relevant arts may be used. For example, while the description above is in terms of a semiconductor wafer, it would be possible to implement the present invention with almost any type of article having a surface or the like. Therefore, the above description and illustrations should not be taken as limiting the scope of the present invention which is defined by the appended claims.

What is claimed is:

1. A method for polishing an object, the method comprising:

placing a contact portion of a polishing pad in contact with a target surface of the object to be planarized over a contact area which is smaller in area than the target surface;

conditioning with a conditioning plate a noncontact portion of the polishing pad which is not in contact with the target surface of the object; and moving the polishing pad relative to the target surface of the object in translation across the target surface of the object to move the noncontact portion in contact with the target surface of the object and move the contact portion out of contact with the target surface of the object;

wherein the conditioning plate moves in translation with the polishing pad, and wherein the polishing pad comprises a planar polishing surface including the contact portion and the noncontact portion which lie on a plane, and wherein the polishing pad has a continuous polishing surface extending from center to edge of the polishing pad.

2. The method of claim 1 wherein conditioning the noncontact portion of the polishing pad comprises dislodging particles from a surface thereof.

3. The method of claim 1 wherein the conditioning plate is an annular plate surrounding the target surface of the object.

4. The method of claim 3 wherein the annular plate is stationary, rotates around the object, or oscillates in rotation relative to the object.

5. The method of claim 1 wherein conditioning the noncontact portion of the polishing pad comprises directing a pressurized fluid to the noncontact portion.

6. The method of claim 1 wherein the noncontact portion of the polishing pad is conditioned during planarization of the object by the polishing pad.

7. The method of claim 1 wherein the noncontact portion of the polishing pad is conditioned continuously during planarization of the object by the polishing pad.

8. The method of claim 1 wherein the polishing pad is rotated relative to the object to move the noncontact portion in contact with the target surface of the object and move the contact portion out of contact with the target surface of the object.

9. The method of claim 1 wherein the object is rotated around an axis perpendicular to the target surface.

10. The method of claim 1 further comprising delivering an abrasive to the contact area between the polishing pad and the target surface of the object.

11. The method of claim 1 further comprising coupling the polishing pad to a substrate which is removably coupled to a polishing head.

12. The method of claim 11 further comprising coupling the polishing head to a substrate coupled to a first polishing pad from a first magazine.

13. The method of claim 12 further comprising decoupling the first substrate coupled to the first polishing pad from the polishing head at a disposal site.

14. The method of claim 13 further comprising coupling the polishing head to a substrate coupled to a second polishing pad from a second magazine.

15. The method of claim 1 wherein the polishing pad has an outer diameter which is smaller than an outer diameter of the target surface of the object.

* * * * *